US005836277A

United States Patent [19]

Kira et al.

[11] Patent Number: 5,836,277

[45] Date of Patent: Nov. 17, 1998

[54] VALVE TIMING CONTROL DEVICE

[75] Inventors: Naoki Kira, Anjo; Katsuhiko Eguchi, Kariya; Kazumi Ogawa; Motoo Nakamura, both of Toyota, all of Japan

[73] Assignee: Aisin Seiki Kabushiki Kaisha, Aichi, Japan

[21] Appl. No.: 996,520

[22] Filed: Dec. 23, 1997

[30] Foreign Application Priority Data

| | | | |
|---|---|---|---|
| Dec. 24, 1996 | [JP] | Japan | 8-344122 |
| Feb. 26, 1997 | [JP] | Japan | 9-042741 |
| Oct. 30, 1997 | [JP] | Japan | 9-298786 |

[51] Int. Cl.[6] ..... F01L 1/34

[52] U.S. Cl. ..... 123/90.17; 123/90.31; 74/568 R; 464/2

[58] Field of Search ..... 123/90.17, 90.31, 123/90.15, 90.16; 74/568 R; 464/2

[56] References Cited

U.S. PATENT DOCUMENTS

| | | | |
|---|---|---|---|
| 4,858,572 | 8/1989 | Shirai et al. . | |
| 5,377,638 | 1/1995 | Mueller | 123/90.17 |
| 5,450,825 | 9/1995 | Geyer et al. | 123/90.17 |
| 5,666,914 | 9/1997 | Ushida et al. | 123/90.17 |
| 5,722,356 | 3/1998 | Hara | 123/90.17 |

FOREIGN PATENT DOCUMENTS

| | | |
|---|---|---|
| 2-50105 | 4/1990 | Japan . |

*Primary Examiner*—Denise L. Ferensic
*Assistant Examiner*—John Ball
*Attorney, Agent, or Firm*—Hazel & Thomas

[57] ABSTRACT

A valve timing control device includes a rotation shaft for opening and closing a valve, a rotation transmitting member rotatably mounted on the rotation shaft, a vane connected to one of the rotation shaft and the rotation transmitting member, a chamber defined between the rotation shaft and the rotation transmitting member and divided into a first pressure chamber and a second pressure chamber by the vane extending into the chamber, a first fluid passage in fluid communication with the first pressure chamber for supplying and discharging the fluid therein and therefrom, respectively, a second fluid passage in fluid communication with the second pressure chamber for supplying and discharging the fluid therein and therefrom, a retracting hole formed on one of the rotation shaft and the rotation transmitting member, a locking pin slidably fitted in the retracting hole and urged toward the other of the rotation shaft and the rotation transmitting member, a receiving hole formed on the other of the rotation shaft and the rotation transmitting member and in which a part of the locking pin is fitted when the relative phase between the rotation shaft and the rotation transmitting member is in a predetermined phase, and a third fluid passage in fluid communication with the receiving hole only when the relative phase between the rotation shaft and the rotation transmitting member is in the predetermined phase.

6 Claims, 14 Drawing Sheets

VALVE TIMING CONTROL DEVICE

BACKGROUND OF THE INVENTION

1. Field of the Invention

The present invention relates to a valve timing control device and in particular to a valve timing control device for controlling an angular phase difference between a crank shaft of a combustion engine and a cam shaft of the combustion engine.

2. Description of the Prior Art

In general, a valve timing of a combustion engine is determined by valve mechanisms driven by cam shafts according to a characteristic of the combustion engine or a use of the combustion engine. Since a condition of the combustion is changed in response to the rotational speed of the combustion engine and so on, however, it is difficult to obtain an optimum valve timing through the whole rotational range. Therefore, a valve timing control device which is able to change a valve timing in response to the condition of the combustion engine has been proposed as an auxiliary mechanism of the valve mechanism in recent years.

A conventional device of this kind is disclosed, for example, in Japanese utility-model application laid-open publication No. 2(1990)-50105. This conventional device includes a rotation shaft for opening and closing a valve, a rotation transmitting member rotatably mounted on the rotation shaft for transmitting a rotational torque from a crank shaft of an engine, a plurality of vanes connected to the rotation shaft, a plurality of chambers defined between the rotation shaft and the rotation transmitting member and divided into a first pressure chamber and a second pressure chamber by the vane, respectively, a first fluid passage being in fluid communication with the first pressure chambers for supplying and discharging the fluid therein and therefrom, respectively, a second fluid passage being in fluid communication with the second pressure chambers for supplying and discharging the fluid therein and therefrom, respectively, a retracting hole formed on the rotation transmitting member, a locking pin disposed in the retracting hole and urged toward the rotation shaft, a receiving hole formed on the rotation shaft and in which a head portion of the locking pin is fitted therein when the receiving hole is brought into alignment with the retracting hole and a third fluid passage being in fluid communication with the receiving hole for supplying and discharging the fluid therein and therefrom.

In this valve timing control device, the third fluid passage is always in fluid communication with the first fluid passage. Therefore, when the fluid is supplied to the first pressure chambers via the first fluid passage and the fluid is discharged from the second pressure chambers, the fluid is also supplied to the receiving hole from the first fluid passage via the third fluid passage and the head portion of the locking pin moves out the receiving hole against the urging force. Thereby, the rotation shaft is rotated toward the advance side relative to the rotation transmitting member after the locking condition between the rotation shaft and the rotation transmitting member by the locking pin is released. Further, when the fluid is supplied to the second pressure chambers via the second fluid passage and the fluid is discharged from the first pressure chambers via the first fluid passage, the rotation shaft is rotated toward the retard side relative to the rotation transmitting member and the fluid is discharged from the third fluid passage via the first fluid passage so that the locking pin is moved by the urging force. Thereby, when the receiving hole is brought into alignment with the retracting hole, the head portion of the locking pin is fitted into the receiving hole by the urging force, and the relative rotation between the rotation shaft and the rotation transmitting member is locked.

In the above prior device, when the fluid pressure in the third fluid passage acts on the locking pin moved into the retracting hole via the receiving hole, the pressure fluctuation generated in the first pressure chambers and the first fluid passage is transmitted to the receiving hole via the third passage and the locking pin vibrates in the retracting hole by the pressure fluctuation. As a result, acoustic noise is generated by this vibration of the locking pin during the running of the engine. Further, the durability of the lock pin and the retracting hole are decreased by the vibration of the locking pin, and thus the reliability of the valve timing control device is decreased.

SUMMARY OF THE INVENTION

It is, therefore, an object of the present invention to provide an improved valve timing control device which overcomes the above drawback.

It is another object of the present invention to provide an improved valve timing control device which can reduce the generation of the noise and which can improve its reliability.

In order to achieve these objectives, there is provided an improved valve timing control device which includes a rotation shaft for opening and closing a valve, a rotation transmitting member rotatably mounted on the rotation shaft, a vane connected to one of the rotation shaft and the rotation transmitting member, a chamber defined between the rotation shaft and the rotation transmitting member and divided into a first pressure chamber and a second pressure chamber by the vane being extended into the chamber, a first fluid passage being in fluid communication with the first pressure chamber for supplying and discharging the fluid therein and therefrom, respectively, a second fluid passage being in fluid communication with the second pressure chamber for supplying and discharging the fluid therein and therefrom, a retracting hole which is formed on one of the rotation shaft and the rotation transmitting member, a locking pin slidably fitted in the retracting hole and urged toward the other of the rotation shaft and the rotation transmitting member, a receiving hole which is formed on the other of the rotation shaft and the rotation transmitting member and in which a part of the locking pin is fitted when the relative phase between the rotation shaft and the rotation transmitting member is in a predetermined phase and a third fluid passage being in fluid communication with the receiving hole only when the relative phase between the rotation shaft and the rotation transmitting member is in the predetermined phase.

BRIEF DESCRIPTION OF THE DRAWINGS

Additional objects and advantages of the present invention will become more apparent from the following detailed description of preferred embodiments thereof when considered with reference to the attached drawings, in which.

DESCRIPTION OF THE PREFERRED EMBODIMENTS

A valve timing control device in accordance with preferred embodiments of the present invention will be described with reference to the attached drawings.

Figure 1:
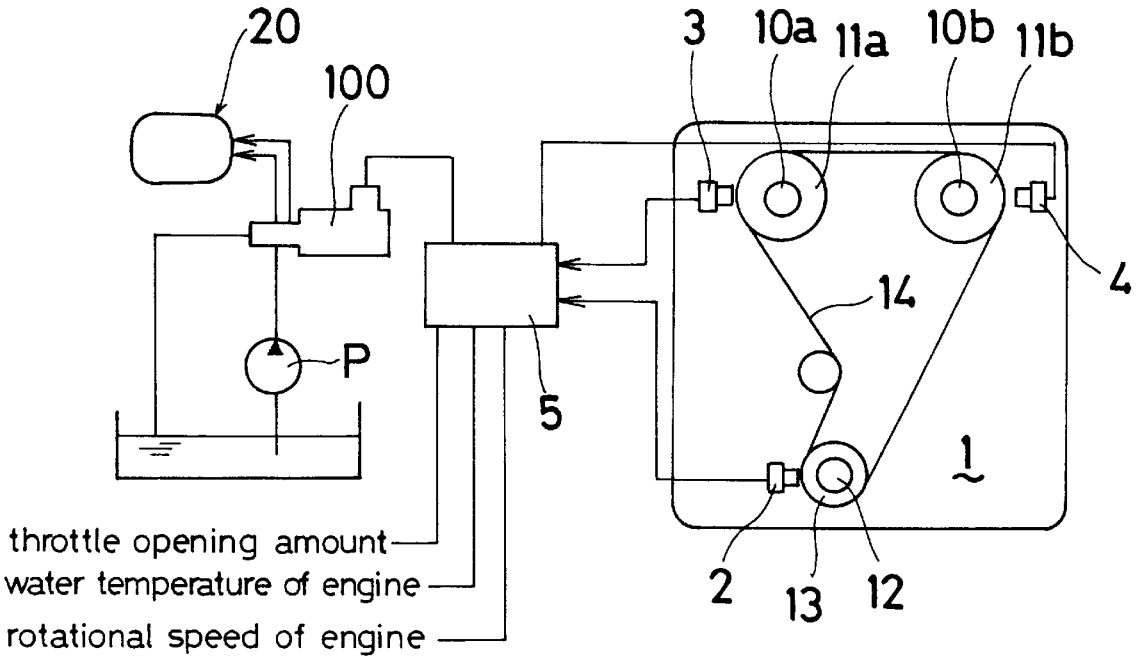
FIG. 1 shows a general sectional view of a first embodiment of a valve timing control device in accordance with the present invention.

FIG. 1 shows a general view of a valve timing control device in accordance with the present invention. In FIG. 1, timing pulleys 13, 11*a* and 11*b* are fixed to a crank shaft 12, an intake cam shaft 11*a* having cam portions (not shown) serving for opening and closing intake valves (not shown) and an exhaust cam shaft 11*b* having cam portions (not shown) serving for opening and closing exhaust valves (not shown), respectively. A rotational torque of the engine 1 is transmitted from the crank shaft 12 to the cam shafts 10*a* and 10*b* via a timing belt 14 made of rubber or resin. The rotational position of the crank shaft 12 and the cam shafts 10*a* and 10*b* are detected by rotational angle sensors 2, 3 and 4, respectively, and the detected signals are fed to a controller 5. A throttle opening amount signal, a rotational speed signal of the engine and a cooling water temperature signal of the engine are fed to the controller 5. The controller 5 supplies a control signal to a changeover valve 100 in response to these signals.

Figure 2:
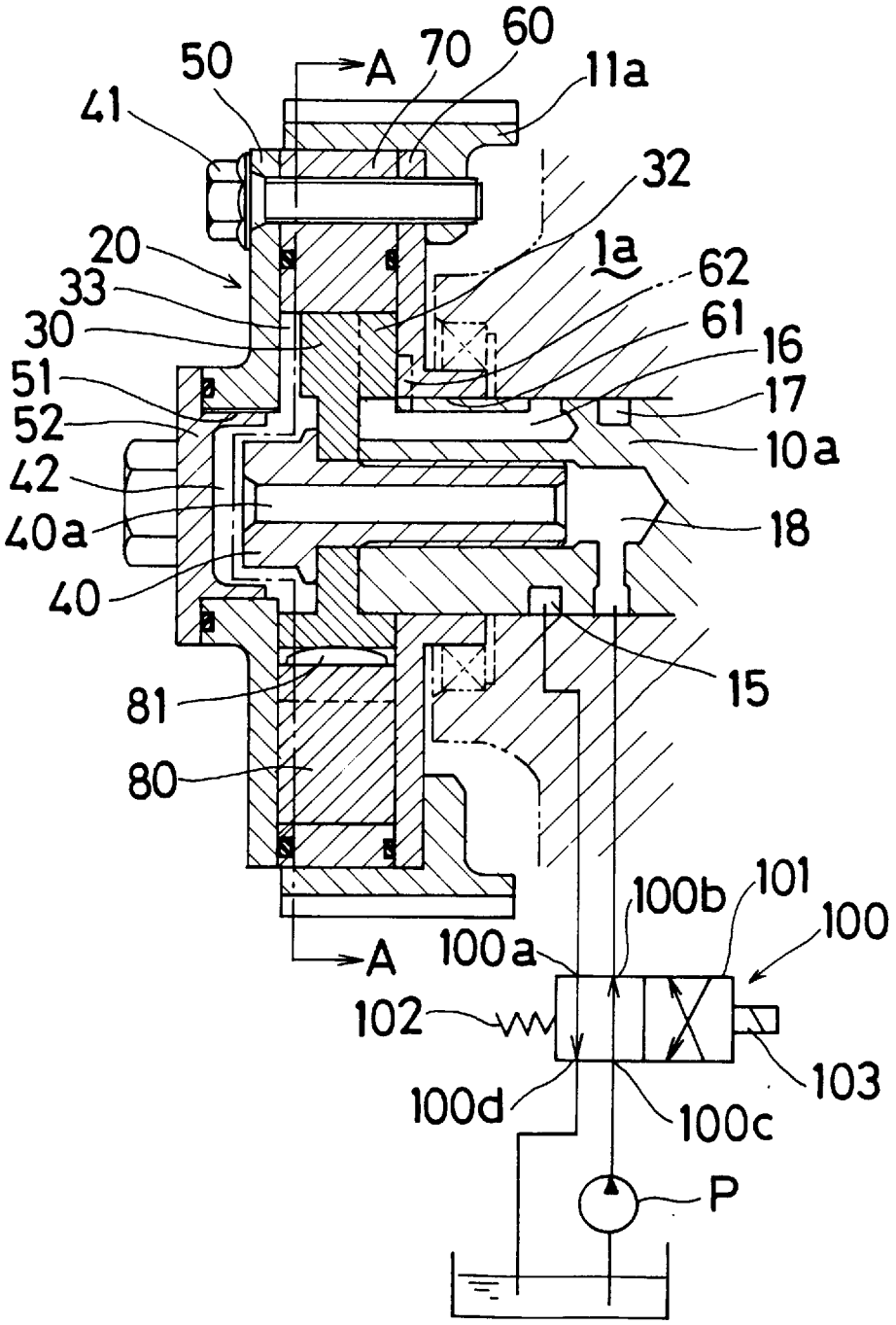
FIG. 2 shows a sectional view of a first embodiment of a valve timing control device in accordance with the present invention.
Figure 3:
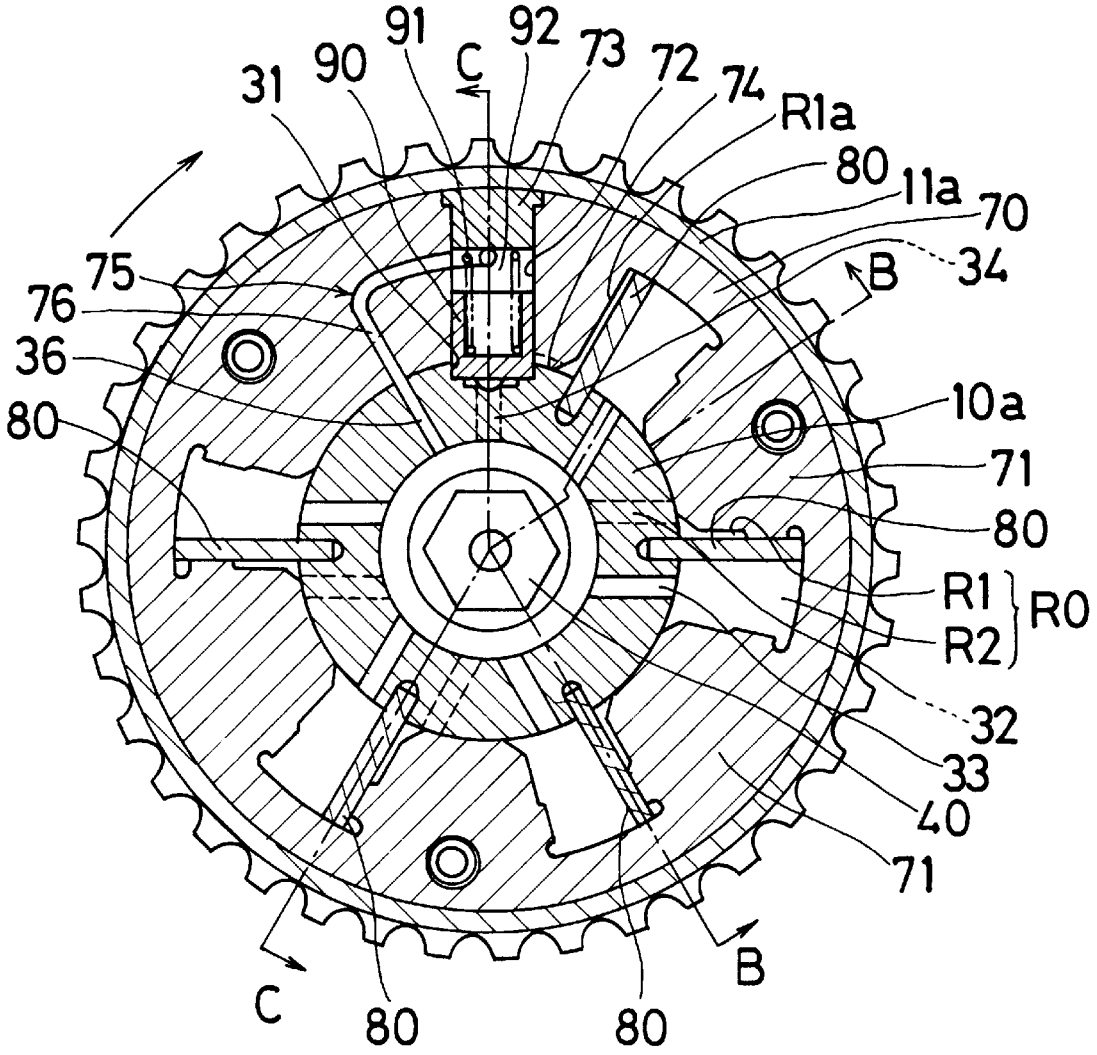
FIG. 3 shows a cross-sectional view taken on line A—A of FIG. 2.
Figure 4:
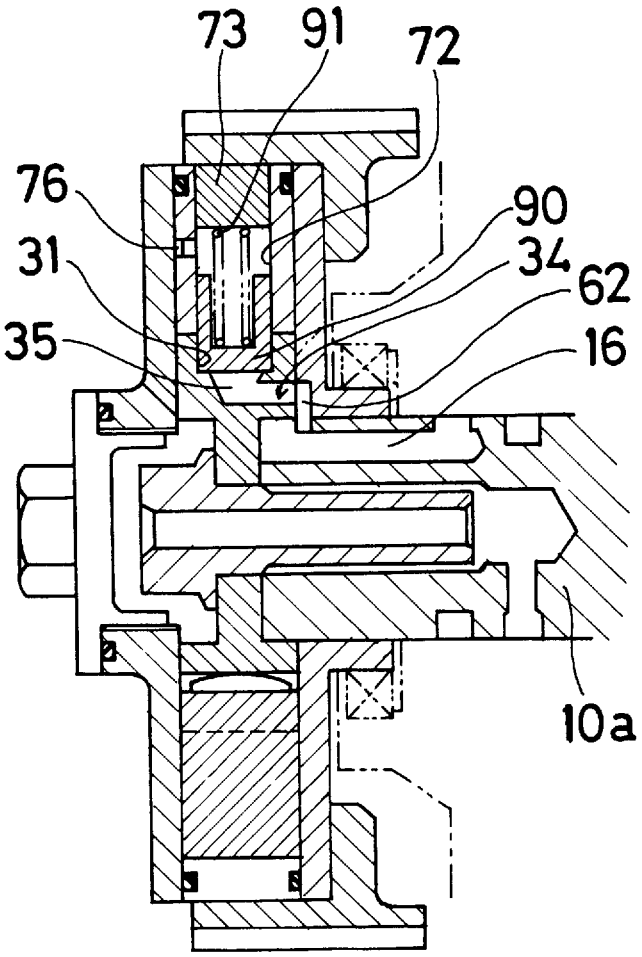
FIG. 4 shows a cross-sectional view taken on line C—C of FIG. 2.

FIG. 2 to FIG. 6 show a first embodiment of the present invention. Referring to FIG. 2, the cam shaft 10*a* which corresponds to a part of a rotation shaft of the present invention is rotatably mounted on a cylinder head 1*a* of the engine 1. A valve timing control device 20, as will become apparent from the following description, is provided between one end portion of the cam shaft 10*a* and the timing pulley 11*a*. FIG. 3 shows a cross-sectional view taken on line A—A of FIG. 2 and FIG. 2 shows a cross-sectional view taken on line B—B of FIG. 3. Further, FIG. 4 shows a cross-sectional view taken on line C—C of FIG. 3.

As shown in FIG. 2 and FIG. 3, an inner rotor 30 is fixed to one end portion of the cam shaft 10*a* by a hollow bolt 40 so as to rotate with the cam shaft 10*a* in a body. On an outer circumferential surface of the inner rotor 30, an outer rotor 70 is rotatably mounted thereon. On the sides of the outer rotor 70, a front plate 50 and a rear plate 60 are disposed. The outer rotor 70, the plate 50 and the rear plate 60 are fastened by bolts 41 so as to prevent a rotation of any one of the members 50, 60, 70 and 11*a* relative to the other members, and these four members 50, 60, 70 and 11*a* correspond to a rotation transmitting member of the present invention. An inner circumferential surface of the rear plate 60 is rotatably fitted on the cam shaft 10*a*. A plug 52 is fluid-tightly screwed into an inner circumference 51 of the front plate 51.

Five pressure chambers R0 are formed, each of which is defined by two adjacent partition walls 71 in the circumferential direction between the inner circumference surface of the outer rotor 10 and the outer circumference surface of the inner rotor 30. Each pressure chamber R0 is defined by the front plate 50 and the rear plate 60 in the axial direction and is defined by the outer rotor 70 and the inner rotor 30 in the radial direction. Each pressure chamber R0 is divided into a first pressure chamber R1, R1*a* and a second pressure chamber R2 by a vane 80. Each vane 80 is mounted into a groove formed on the outer circumference of the inner rotor 30 such that the vane 80 extends outwardly along the radial direction of the inner rotor 30, and is received in the pressure chamber R0. Each vane 80 is urged outwardly by a spring 81 which is disposed at the bottom portion of the groove of the inner rotor 30 (FIG. 2) so as to be in sliding engagement with a bottom of the pressure chamber R0. The timing pulley 11*a* is rotated clockwise as shown in FIG. 3. Further, at the inner circumference surface of the outer rotor 70, a sole retracting hole 72 which penetrates in the radial direction in formed. In the retracting hole 72, a locking pin 90 whose head portion can be fitted into a receiving hole 31 formed on the outer circumferential surface of the inner rotor 30 is disposed therein. In this first embodiment, the retracting hole 72 and the receiving hole 31 are formed so that the head portion of the locking pin 90 is fitted into the receiving hole 31 when the relative rotational phase between the rotation shaft and the rotation transmitting member is in a maximum retarded condition shown in FIG. 3 and FIG. 5. The radially outer end of the retracting hole 72 is fluid-tightly closed by a plug 73 and a spring 91 is disposed between the plug 73 and the locking pin 90 so as to urge the locking pin 90 toward the inner rotor 30.

The valve timing control device 20 controls the relative rotational phase between the rotation shaft and the rotation transmitting member by the pressure difference between the first pressure chamber R1 and the second pressure chamber R2. This pressure difference is controlled by the changeover valve 100. The fluid passage (the first fluid passage) between the changeover valve 100 and each of the first pressure chambers R1 comprises a first circular groove 15 which is formed on the cam shaft 10*a*, an axial hole 16 which is formed in the cam shaft 10*a* so as to extend in the axial direction and first grooves 32 which are formed on the inner rotor 30 so as to extend in the radial direction. The fluid passage (the second fluid passage) between the changeover valve 100 and each of the second pressure chambers R2 comprises a second circular groove 17 which is formed on the cam shaft 10*a*, a central hole 18 which is formed at axial center of the cam shaft 10*a* so as to extend in the axial direction, a hollow portion 40*a* of the hollow bolt 40, a space between the head portion of the hollow bolt 40 and the plug 52 and second grooves 33 which are formed on the inner rotor 30 so as to extend in the radial direction.

A third passage 34 is formed in the inner rotor 30 so as to communicate between the axial hole 16 and the receiving hole 31. As shown in FIG. 4, the third passage 34 is provided with a first part 35 which is formed on the inner rotor 30 and a second part 62 which is formed on the rear plate 60 and the cam shaft 10*a*. The second part 62 comprises of a groove which is formed on the side face of the rear plate 60 opposing to the inner rotor 30 and a hole which is formed in the cam shaft 10*a* so as to communicates between the groove and the axial hole 16. The first part 35 and the second part 62 communicate with each other only when the receiving hole 31 is brought into alignment with the retracting hole 72. The third hole 34 is communicated to the first pressure chamber R1*a* via a communicating passage 74 after the locking pin 90 is moved out the receiving hole 31. The communicating passage 74 is formed on the inner circumferential surface of the outer rotor 70 and communicates the retracting hole 72 to the first pressure chamber R1*a* adjacent to the retracting hole 72. It is possible to communicate the first pressure chamber R1*a* with the axial hole 16 via the first groove 32. Thereby, the rotational torque of the inner rotor 30 is increased.

A back chamber 92 in which the spring 91 is disposed communicates with the space 42 via a fourth passage 75. The fourth passage 75 is provided with a first part 36 which is formed as a groove on the axial surface of the inner rotor 30 opposing to the front plate 50 and a second part 76 which is formed as a groove on the axial surface of the outer rotor 70 opposite the front plate 50. The first part 36 and the second part 76 communicate with each other only when the receiving hole 31 is brought into alignment with the retracting hole 72.

As shown in FIG. 2, the first circular groove 15 is communicated to a connecting port 100*a* of the changeover valve 100 and the second circular groove 17 is communicated to a connecting port 100*b* of the changeover valve 100. The changeover valve 100 is constructed in such a manner that when a solenoid 103 is energized, a spool 101 is moved against an urging force of a spring 102 in the leftward direction. While the spool 101 remains in the illustrated condition in which the solenoid 103 is not energized, the changeover valve 100 establishes fluid communication between the connecting port 100*b* and a supply port 100*c* which communicates with the oil pump P as well as establishes fluid communication between the connecting port 100*a* and a drain port 100*d*. When the solenoid 103 is energized, the changeover valve 100 establishes fluid communication between the connecting port 100*b* and the drain port 100*d* as well an establishes a fluid communication between the connecting port 100*a* and the supply port 100*c*. Thus, the oil is supplied to the axial hole 16 while the solenoid 103 is energized and the oil is supplied to the central hole while the solenoid 103 in not energized.

The operation of the valve timing control device having the above structure will now be described.

Figure 5:
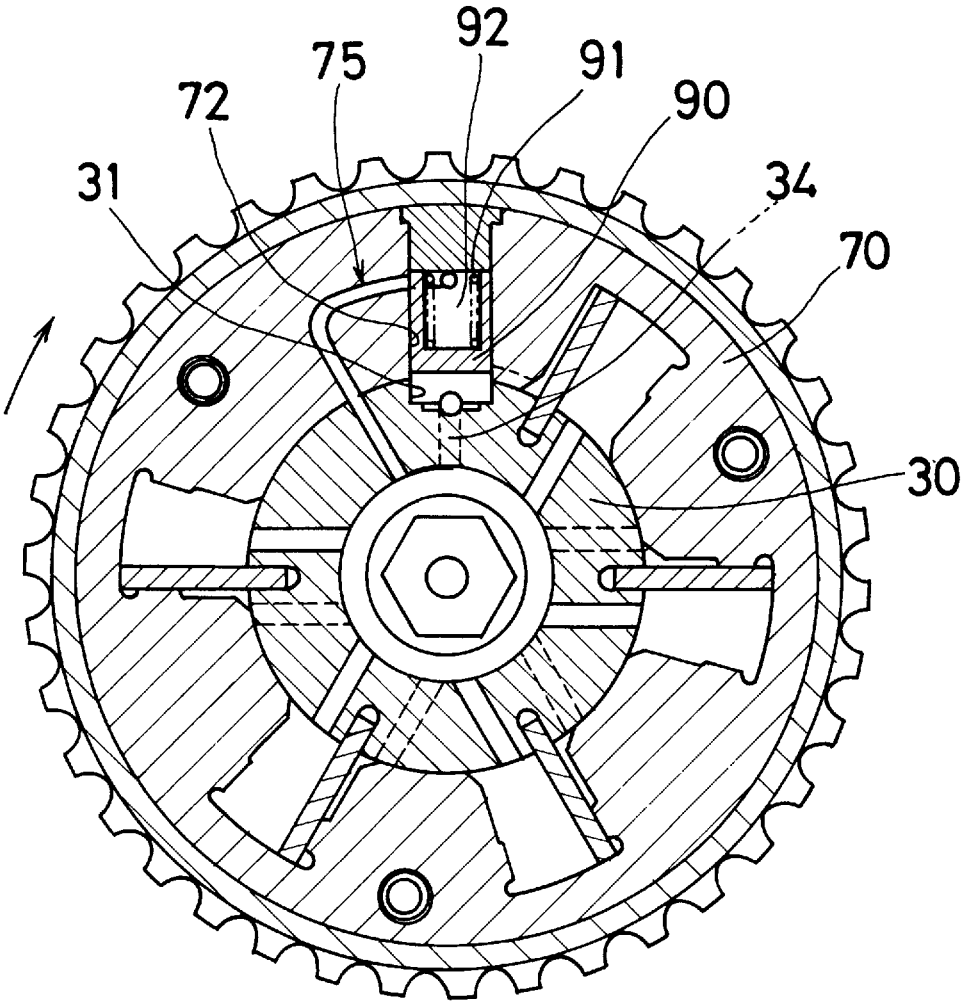
FIG. 5 shows a sectional view of the first embodiment of a valve timing control device in which the locking pin is moved out the receiving hole.
Figure 6:
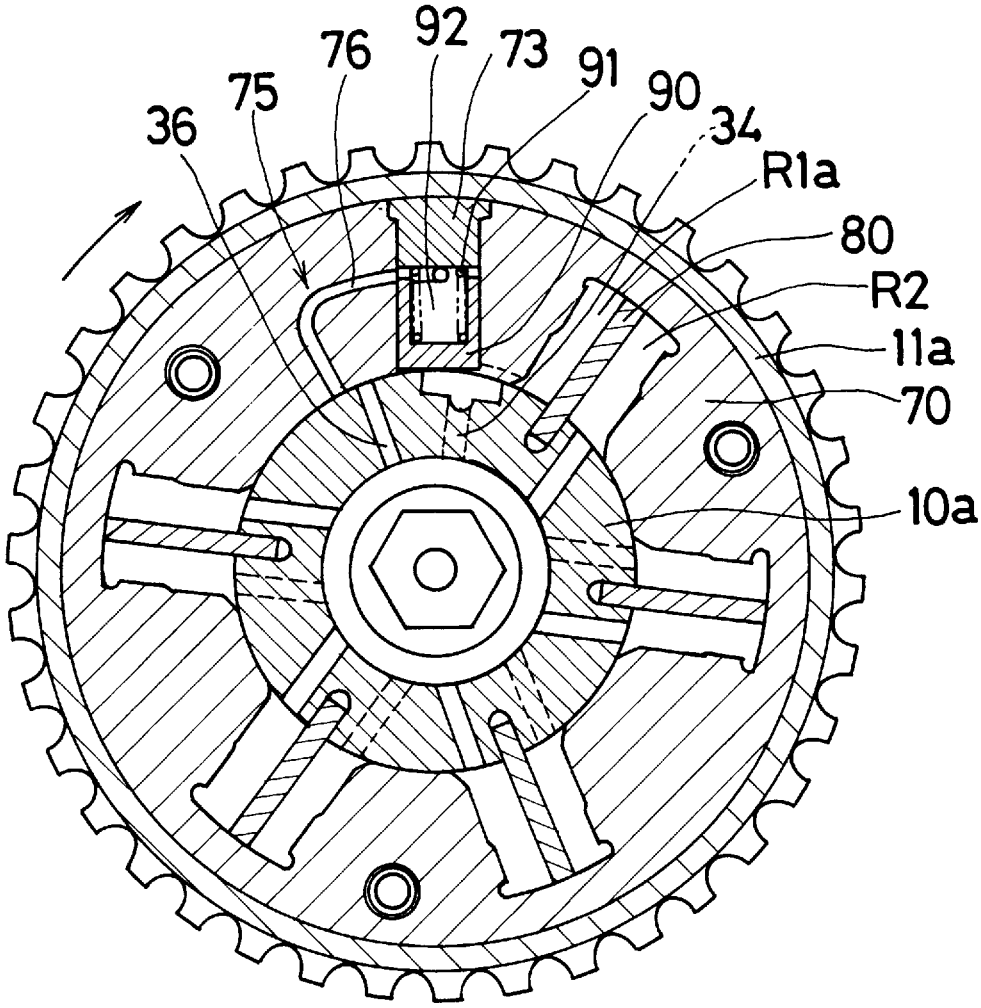
FIG. 6 shows a sectional view of the first embodiment of a valve timing control device in which the rotation shaft is rotated toward advance side relative to the rotation transmitting member.

If an advance of the phase angle is desired while the inner rotor 30 and the outer rotor 70 are at its maximum retarded position as shown in FIG. 3, the solenoid 103 of the changeover valve 100 is energized and the oil is supplied into the first pressure chambers R1 as well as the oil is discharged from the second pressure chambers R2. At this time, since the oil is also supplied to third passage 34 and the oil is discharged from back chamber 92 via the fourth passage 75, the locking pin 90 is moved out of the receiving hole 31 as shown in FIG. 5 and its head portion is located in the retracting hole 72. Accordingly, the inner rotor 30 and the vanes 80 can rotate relative to the outer rotor 70, the front plate 50, the rear plate 60 and the timing pulley 11*a*. Then, as shown in FIG. 6, due to the pressure difference between the first pressure chambers R1 and the second pressure chambers R2, the inner rotor 30 and the vanes 80 are rotated clockwise relative to the outer rotor 70, the front plate 50, the rear plate 60 and the timing pulley 11*a*. Thereby, the opening and closing timing of the valves (not shown) driven by the cam shaft 10*a* is advanced.

When the relative phase between the inner rotor 30 and the outer rotor 70 becomes the phase shown in FIG. 6, the fluid communication between the first part 35 and the second part 62 of the third passage 34 is interrupted as well as the fluid communication between the first part 36 and the second part 76 of the fourth passage 75 is interrupted. Therefore, if the torque variation due to the opening and closing operation of the valves (not shown) acts on the cam shaft 10*a* and the pressure in the first pressure chambers R1 and the second pressure chambers R2 change by the changing of the position of the vanes 80, this change of the oil pressure (pulsation) does not transmit to the locking pin 90. Therefore, the locking pin 90 does not vibrate in the retracting hole 72 and the acoustic noise is not generated.

On the other hand, when the relative rotation between the outer rotor 70 and the inner rotor 30 is desired to change from the advanced condition shown in FIG. 6 or the maximum advanced condition to the retarded condition, the oil under pressure is supplied to the second pressure chambers R2 as well as the oil is discharged from the first pressure chambers R1(R1*a*) by de-energizing the changeover valve 100. Thereby, the angular phase of the inner rotor 30 (=the cam shaft 10*a*) is retarded relative to that of the outer rotor 70 (=the crank shaft 12). When the relative phase between the inner rotor 30 and the outer rotor 70 is in the maximum retarded condition shown in FIG. 5, since the first part 34 and the second part 62 of the third passage 34 communicate with each other as well as the first part 36 and the second part 76 of the fourth passage 75 are communicated with each other, the locking pin 90 is moved toward the inner rotor 30 by the spring 91 and the oil pressure in the back chamber 92 and the head portion of the locking pin 90 is fitted into the receiving hole 31.

Figure 7:
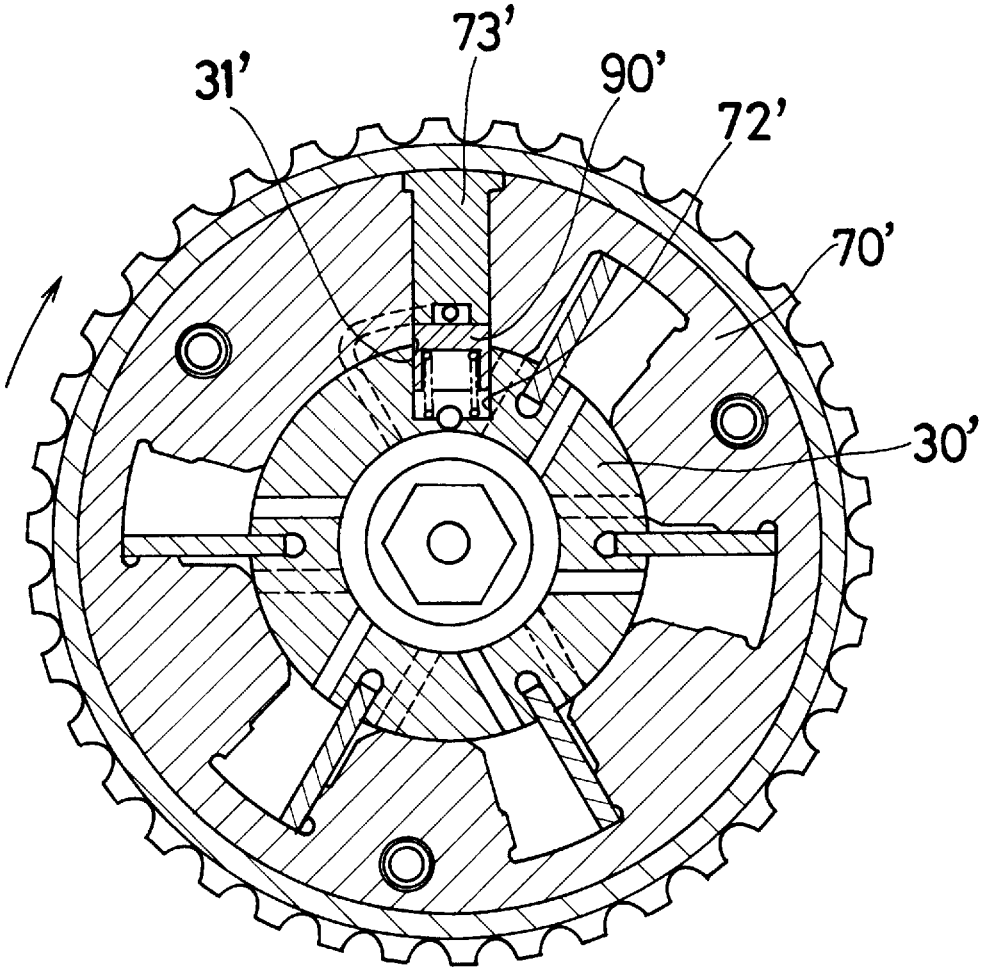
FIG. 7 shows a cross-sectional view of a variation of the first embodiment of a valve timing control device in accordance with the present invention.

FIG. 7 shows a variation of the above first embodiment. In this variation, a retracting hole 72' is formed in an inner rotor 30, and a locking pin 90 is disposed in the retracting hole 72'. A receiving hole 31' is formed in an outer rotor 70'.

In the above first embodiment, the third passage 34 and the fourth passage 75 are divided into the first parts 35, 36 and the second parts 62, 76, respectively and the first parts 35, 36 and the second parts 62, 76 are communicated with each other only when the relative phase between the inner rotor 30 and the outer rotor 70 is in the maximum retarded condition. However, if either the third passage 34 or the fourth passage 75 is divided into the first part and the second part, it is possible to prevent the locking pin from vibrating by the pulsation of the oil pressure. For example, the third passage 34 is not divided into two parts and always communicates to the axial hole 19 as the first groove 32. The fourth passage 75 is divided into the first part 36 and the second part 76. Thereby, when the relative phase between the inner rotor 30 and the outer rotor 70 is in the phase shown in FIG. 6, the fluid communication between the first part 36 and the second part 76 is interrupted. Therefore, even if the oil pulsation acts on the locking pin 90 from the third passage 34, the back chamber 92 functions as a damper and the vibration of the locking pin 90 is prevented.

Further, in the above first embodiment, the rotational torque is transmitted from the crank shaft to the cam shaft via the timing belt. However, it is possible to transmit the rotational torque via a chain or gears. In this case, since it is able to discharge the oil which leaks from the receiving hole to the back chamber through a sliding clearance between the locking pin and the retracting hole, it is able to not use the fourth passage. Further, in this first embodiment, the third passage 34 is communicated to the first pressure chambers R1. However, it is possible to communicate the third passage 34 to the second pressure chambers R2. In this case, it is not necessary to communicate the third passage 34 to the first pressure chamber R1*a* via the communicating passage 74 but it is necessary to form an additional first groove 32 communicating between the first pressure chamber R1*a* and the axial hole 16.

As mentioned above, in the above first embodiment, the opening and closing timing of the valves (not shown) driven by the cam shaft 12 is adjusted and the angular phase difference between the crank shaft 12 and the cam shaft 10*a* is adjusted. According to the first embodiment, since the oil pressure is not applied to the locking pin 90 when the whole of the locking pin 90 is located in the retracting hole 72, the locking pin 90 is prevented from vibrating as a result of pressure pulsations. Thereby, acoustic noise generated by the vibration of the locking pin 90 is also prevented.

FIG. 8 to FIG. 14 show a second embodiment of the present invention. In FIG. 6 to FIG. 14, the same parts as compared with FIG. 1 to FIG. 7 are identified by the same reference numerals.

Referring to FIG. 8 to FIG. 14, a cam shaft 210 which is provided with a plurality of cam portions (not shown) driving intake valves (not shown) is rotatably supported on a cylinder head 280 of an engine at its plural journal portions. The cam shaft 210 comprises a rotation shaft of the present invention together with a sensor plate 220 for detecting rotational position, an inner rotor 230 which is fixed to an end of the cam shaft 210 projecting out of the cylinder head 280 and vanes 240 which are mounted on the inner rotor 230. The valve timing control device includes the rotation shaft and a rotation transmitting member being comprised of an outer rotor 250 which is rotatably mounted on the inner rotor 230, a locking pin 260 and a timing sprocket 270 which is fixed to the outer rotor 250. A rotational torque is transmitted from a crank shaft 12 via a timing chain 14' to the timing sprocket 270 so that the timing sprocket 270 is rotated clockwise in FIG. 9 and FIG. 10.

Figure 8:
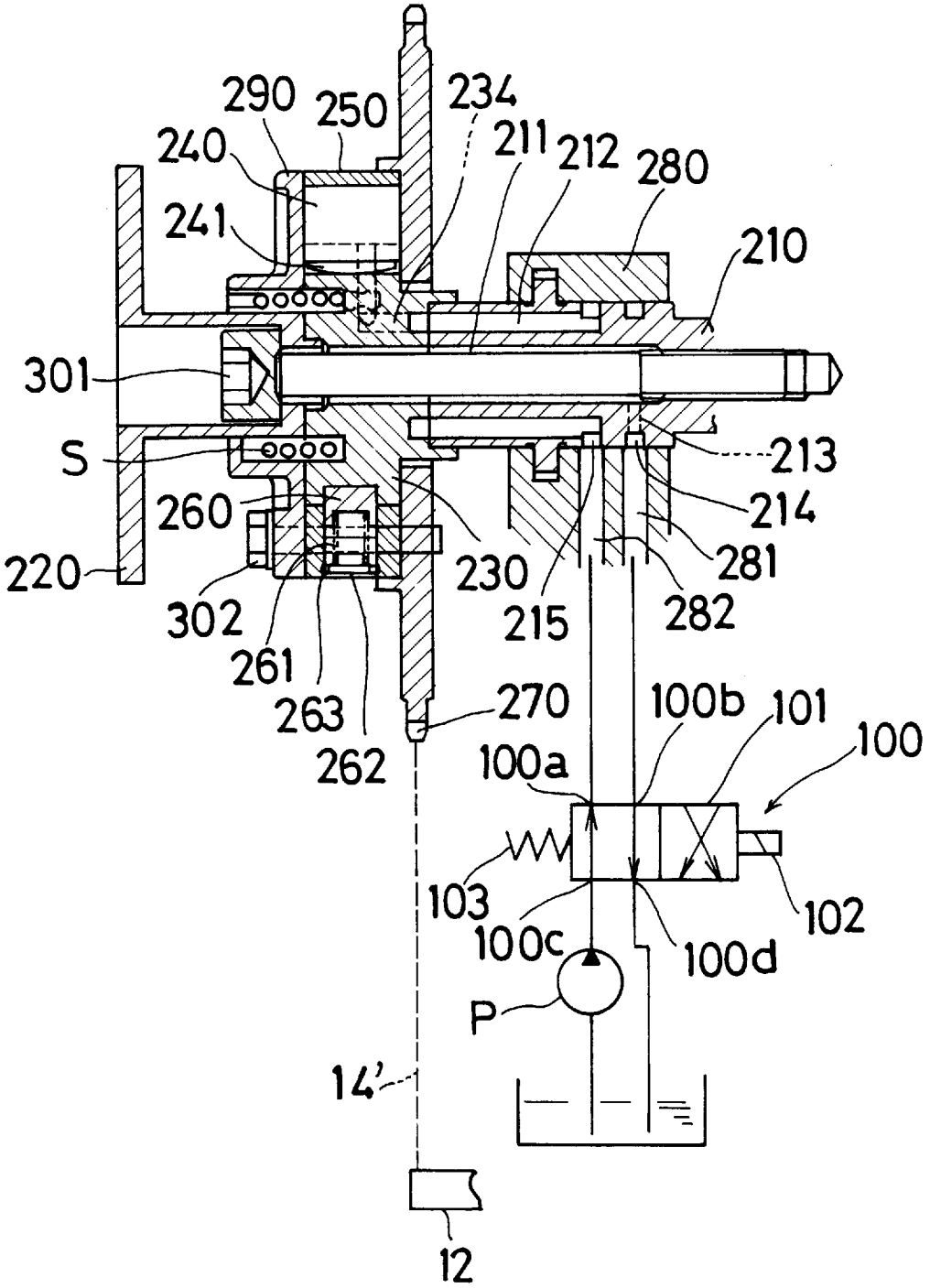
FIG. 8 shows a sectional view of a second embodiment of a valve timing control device in accordance with the present invention.
Figure 9:
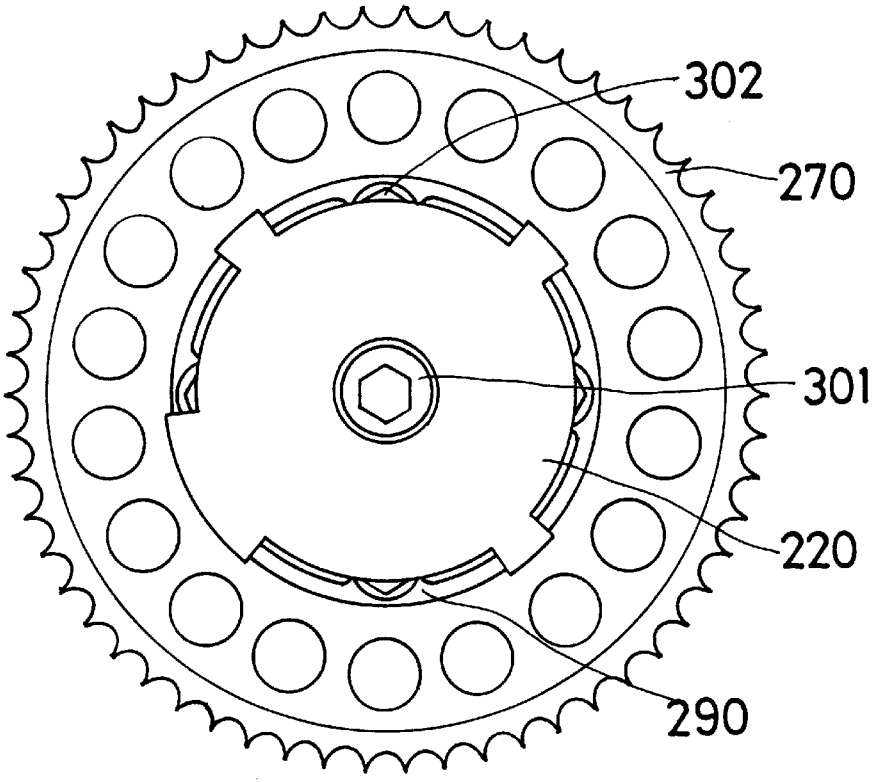
FIG. 9 shows a front view of the second embodiment shown in FIG. 8.

In the cam shaft 210, as shown in FIG. 8, a first passage 211 for supplying and discharging the oil under pressure for advancing is formed at its axial center so as to extend in the axial direction and second passages 212 for supplying and discharging the oil under pressure for retarding are formed in parallel with the first passage 211 so as to extend in the axial direction. The first passage 211 communicates with a connecting port 100*b* of a changeover valve 100 via a radial passage 213, a circular groove 214 and a connecting passage 281. The second passage 212 is communicated to a connecting port 100 of the changeover valve 100 via a circular groove 213 and a connecting passage 282.

The changeover valve 100 is the same as the changeover valve in the above first embodiment. The oil is supplied to the second passage 212 while the solenoid 102 is not energized and the oil is supplied to the first passage 211 while the solenoid 102 is energized.

Figure 10:
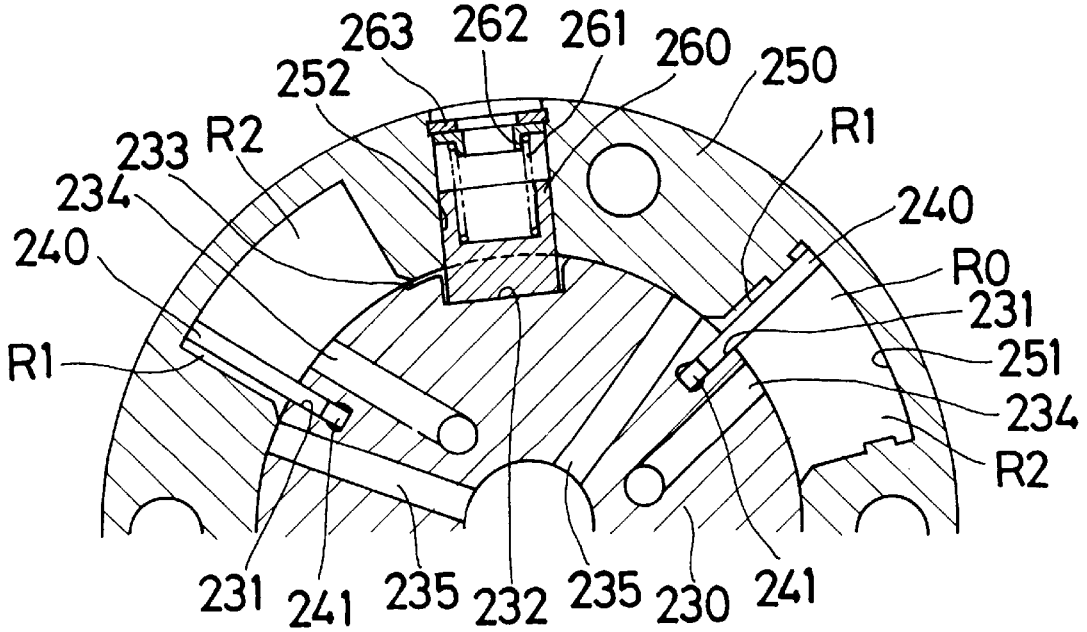
FIG. 10 shows a cross-sectional view of the second embodiment shown in FIG. 8.
Figure 11:
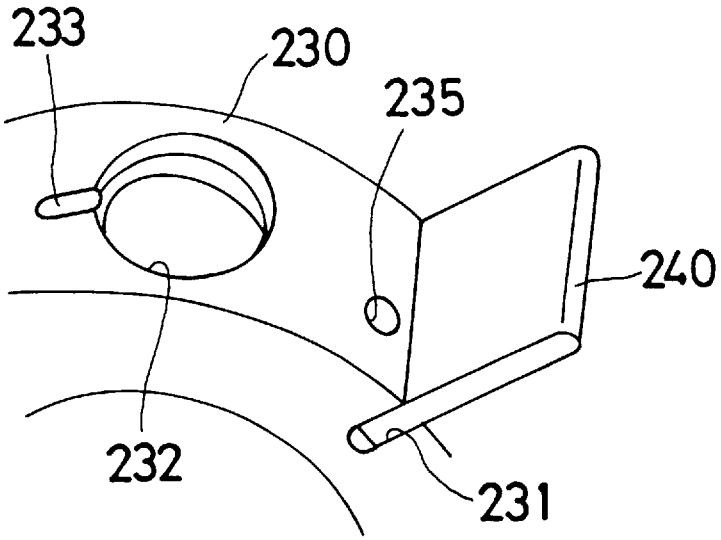
FIG. 11 shows a partly perspective view of the inner rotor and the vane shown in FIG. 8 and FIG. 10.

The inner rotor 230 is fixedly mounted on the projecting end of the cam shaft 210 together with the sensor plate 220 by a hollow bolt 301 so that the relative rotation between the inner rotor 230 and the cam shaft 210 is prevented. On the outer circumferential surface of the inner rotor 230, axial grooves 231 in which the vanes 240 are mounted in the radial direction are formed thereon. Further, the inner rotor 230 is provided with a receiving hole 232 into which a head portion of a locking pin 260 is fitted by a predetermined amount when the relative phase between the inner rotor 230 and the outer rotor 250 is in a predetermined phase shown in FIG. 10, a restricted passage 233 which extends from the opening end of the receiving hole 232 by a predetermined value in the circumferential direction and which communicates with a second pressure chamber R2 divided by a vane 240 as described later when the relative phase between the inner rotor 230 and the outer rotor 250 is in the predetermined phase shown in FIG. 10 (FIG. 11), communicating passages 234 which communicate between the second passage 212 and the second pressure chambers R2 and communicating passages 235 which communicate between the first passage 211 and the first pressure chambers R1 divided by a vane 240 as described later (FIG. 10). Each vanes 240 is urged outwardly in the radial direction by a spring 241 which is disposed on the bottom portion of the groove 231.

The outer rotor 250 is mounted on the outer circumference of the inner rotor 230 so as to be able to rotate with a predetermined amount relative to the inner rotor 230. As shown in FIG. 8, side plate 290 and the timing sprocket 270 are fluid-tightly connected on both sides of the outer rotor 250, and the side plate 290, the timing sprocket and the outer rotor 250 are fastened by bolts 302. Further, concave portions 251 which define pressure chambers R0 together with the inner rotor 230, the side plate 290 and the timing sprocket 270 are formed on the inner circumference of the outer rotor 250. Each vanes 240 is disposed in each pressure chambers R0 and divides the pressure chamber R0 into the first pressure chamber R1 and the second pressure chamber R2. Further, a retracting hole 252 which penetrates in the radial direction and in which the locking pin 260 and a spring 261 urging the locking pin 260 toward the inner rotor 230 are disposed is formed in the outer rotor 250. The retracting hole 252 is in alignment with the receiving hole 232 when the relative phase between the inner rotor 230 and the outer rotor 250 is in the predetermined phase. As shown in FIG. 8, a torsion spring S is disposed between the side plate 290 and the inner rotor 230. One end of the torsion spring S is engaged with the inner rotor 230 and the other end of that is engaged with the side plate 290. Thereby, the cam shaft 210, the inner rotor 230, the vanes 240 and so on are urged counterclockwise relative to the outer rotor 250, the timing sprocket 270, the side plate 290 and so on in FIG. 10.

The locking pin 260 is fitted in the retracting hole 252 so as to be able to move in the radial direction of the outer rotor 250 and is urged toward the inner rotor 230 by a spring 261. The top portion of the locking pin 260 can be fitted and released into and from the receiving hole 232. The spring 261 is a compression spring which is disposed between the locking pin 260 and a retainer 262 and the retainer 262 is prevented from moving out the retracting hole 252 by a clip fixed to the outer rotor 250.

In this second embodiment, while the engine is at rest, the oil pump P also remains non-operational and the changeover valve 100 is in the condition shown in FIG. 8. Therefore, each member is in the condition shown in FIG. 8 to FIG. 10 (the relative phase between the inner rotor 230 and the outer rotor 250 is locked by the locking pin 260 at the maximum retarded condition under which the volume of the each of the second pressure chambers R2 becomes a maximum value) and the oil under pressure is not supplied to the first and second passages 211, 212. Thereby, when the engine is started, unnecessary relative rotation between the rotation shaft comprising of the cam shaft 210, the inner rotor 230, the vanes 240 and so on and the rotation transmitting member comprising of the outer rotor 250, the timing sprocket 270, the side plate 290 and so on due to the large rotational variation, is regulated and drawbacks due to the unnecessary relative rotation between the rotation shaft and the rotation transmitting member (for example, collision noise by the vanes 240) are avoided.

Further, at the starting of the engine, the oil is supplied from the oil pump P to the passage 282 via the changeover valve 100 at least for a predetermined time. Thereby, the oil is supplied to the second pressure chambers R2 via the circular groove 215, the second passages 212 and the communicating passages 234 and the oil is supplied from the second pressure chamber R2 to the receiving hole 232 via the restricted passage 233. The restricted passage 233 and the second pressure chamber R2 constitutes a third passage for supplying and discharging the oil to and from the receiving hole 232. Accordingly, when the locking pin 260 is moved against the spring 261 and a predetermined time (a time required for supplying a predetermined amount of oil to the receiving hole 232 via the restricted passage 233) elapses since the engine is started, the head portion of the locking pin 260 moves from the receiving hole 232 into the retracting hole 252 as shown in FIG. 12 and the locking condition by the locking pin 260 is released.

Figure 12:
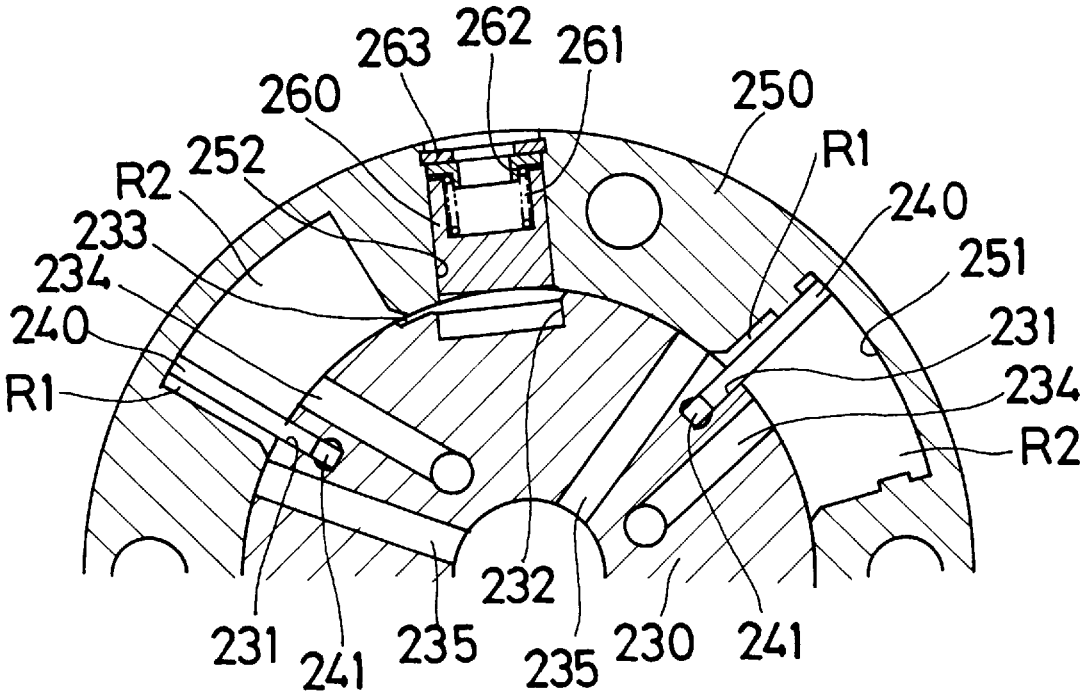
FIG. 12 shows a sectional view of the second embodiment of a valve timing control device in which the locking pin is moved out of the receiving hole.

Accordingly, when the predetermined time elapses from when the engine is started, as shown in FIG. 12, the rotation shaft comprising of the cam shaft 210, the inner rotor 230, the vanes 240 and so on can be rotated relative to the rotation transmitting member which comprises the outer rotor 250, the timing sprocket 270, the side plate 290 and so on. When the oil is discharged from the second pressure chambers R2 and the oil is supplied to the first pressure chambers R1 by the changing operation of the changeover valve 100 in response to the running condition of the engine, the rotation shaft can be rotated relative to the rotation transmitting member from the condition shown in FIG. 12 to the condition shown in FIG. 14 via the condition shown in FIG. 13. Further, when the oil is discharged from the first pressure chambers R1 and the oil is supplied to the second pressure chambers R2 by the changing operation of the changeover valve 100, the rotation shaft can be rotated relative to the rotation transmitting member from the condition shown in FIG. 14 to the condition shown in FIG. 12 via the condition shown in FIG. 13. Thereby, the opening and closing timing of the valves (not shown) driven by the cam shaft 210 is adjusted and the angular phase difference between the crank shaft 12 and the cam shaft 210 is adjusted.

In the above second embodiment, when the receiving hole 232 is in alignment with the retracting hole 252, the oil is discharged from the first pressure chambers R1 via the passages 235, 211, 213, 214 and 281 and the oil is supplied to the second pressure chambers R2 via the passages 282, 215, 212 and 234. In this condition, when the changeover valve is changed, and when the oil in supplied to the first pressure chambers R1 via the passages 235, 211, 213, 214 and 281 and the oil is discharged from the second pressure chambers R2 via the passages 282, 215, 212 and 234, the rotation shaft is rotated relative to the rotation transmitting member, for example, from the condition shown in FIG. 12 to the condition shown in FIG. 13 and the receiving hole 232 is not in alignment with the retracting hole 252. The time required for changing from the alignment condition to the nonalignment condition is a minimum. At this time, since the fluid communication between the receiving hole 232 and the second pressure chamber R2 is restricted and interrupted by the restricted passage 233 and the interruption of the restricted passage 233, the head portion of the locking pin 260 is not fitted into the receiving hole 233.

Further, when the oil is discharged from the first pressure chambers R1 via the passages 235, 211, 213, 214 and 281 and the oil is supplied to the second pressure chambers R2 via the passages 282, 215, 212 and 234, the valve timing control device changes from the non-alignment condition to the alignment condition. At this time, since the oil is supplied from the second pressure chamber R2 to the receiving hole 232 via the restricted passage 233, the head portion of the locking pin 260 is not fitted into the receiving hole 233.

As mentioned above, since the locking pin 260 is not fitted into the receiving hole 232, after the locking pin 260 is moved out of the receiving hole 232, the number of operations associated with the locking pin 260 is remarkably reduced and thereby the durability and the reliability of the locking mechanism is remarkably improved.

Figure 13:
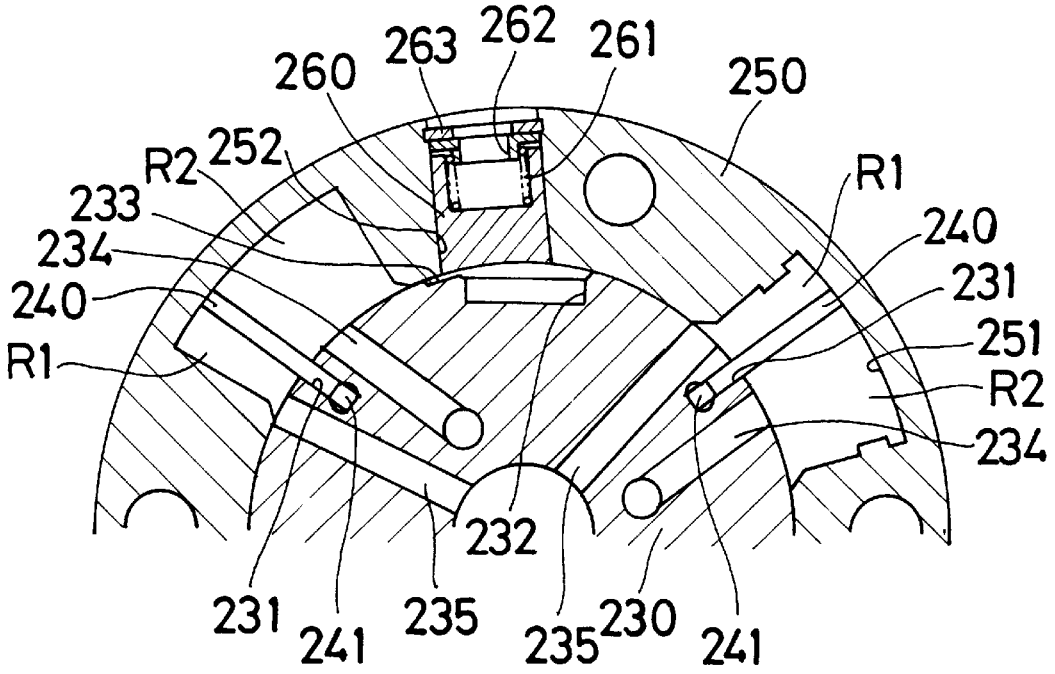
FIG. 13 shows a sectional view of the second embodiment of a valve timing control device in which the rotation shaft is rotated toward the advance side relative to the rotation transmitting member.
Figure 14:
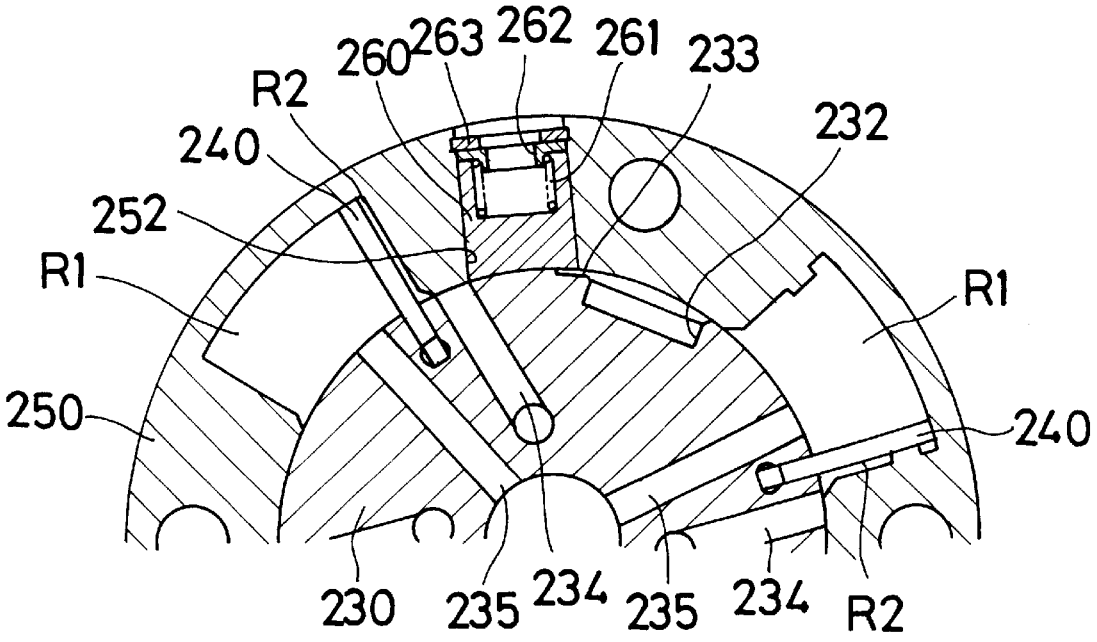
FIG. 14 shows a sectional view of the second embodiment of a valve timing control device which is in the maximum advanced condition.

Further, in the second embodiment, when the receiving hole 232 is not in alignment with the retracting hole 252, an shown in FIG. 13 and FIG. 14, fluid communication between the receiving hole 232 and the second pressure chamber R2 via the restricted passage 233 is interrupted and the receiving hole 232 is sealed or closed. Therefore, in this condition, supplying and discharging the oil to and from the first and second pressure chambers R1 and R2 is controlled. Further, even if the oil pressure in the second pressure chamber R2 changes, the pressure change is not transmitted to the receiving hole 232. Therefore, it is able to prevent the locking pin 260 from vibrating in the retracting hole 52, and it is possible to reduce the acoustic noise generated by the vibration of the locking pin 260.

Further, since the restricted passage 233 is formed on the outer circumferential surface of the inner rotor 230 on which the outer rotor 250 in rotatably mounted, it is able to easily form the restricted passage 233 and therefore it is able to reduce the manufacturing cost of the valve timing control device.

In this second embodiment, the torsion spring S is disposed between the side plate 290 and the inner rotor 230 and each member is in the condition shown in FIG. 10 at the initial off or starting condition of the engine. Since the timing sprocket 270 is rotated clockwise in FIG. 9 and FIG. 10, even if the torsion spring S does not exist, each member is in the condition shown in FIG. 10 when the engine starts. Therefore, it is able to not use the torsion spring S.

FIG. 15 to FIG. 18 show a third embodiment of the present invention. In FIG. 15 to FIG. 18, the same parts as compared with FIG. 1 to FIG. 7 are identified by the same reference numerals.

Referring to FIG. 15 to FIG. 18, a cam shaft 510 which is provided with a plurality of cam portions (not shown)

driving intake valves (not shown) is rotatably supported on a cylinder head of an engine at its plural journal portions. The cam shaft 510 comprises a rotation shaft of the present invention together with an inner rotor 520 which is fixed to an end of the cam shaft 510) projecting out of the cylinder head and vanes 570 which are mounted on the inner rotor 520. The valve timing control device includes the rotation shaft and a rotation transmitting member being comprised of an outer rotor 530 which is rotatably mounted on the inner rotor 520, a locking pin 580 and a timing sprocket 531 which is formed on the outer rotor 530 in a body. A rotational torque is transmitted from a crank shaft 12 via a timing chain 14' to the timing sprocket 531 so that the timing sprocket 531 is rotated clockwise in FIG. 16.

Figure 15:
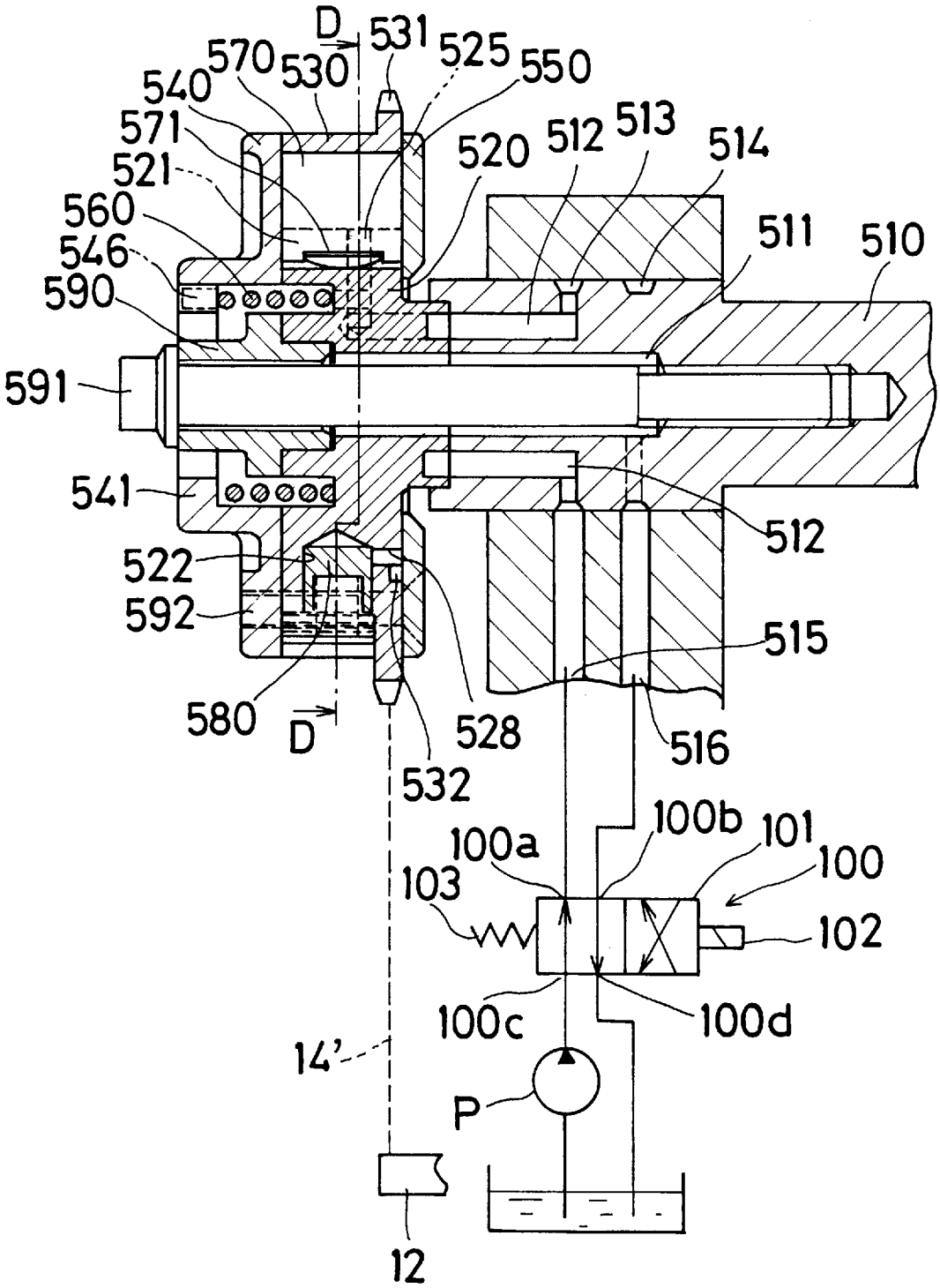
FIG. 15 shows a sectional view of a third embodiment of a valve timing control device in accordance with the present invention.

In the cam shaft 510, as shown in FIG. 15, a first passage 511 for supplying and discharging the oil under pressure for advancing is formed at its axial center so as to extend in the axial direction and second passages 512 for supplying and discharging the oil under pressure for retarding are formed in parallel with the first passage 511 so as to extend in the axial direction. The first passage 511 is communicated to a connecting port 100*b* of a changeover valve 100 via a radial passage, a circular groove 514 and a connecting passage 516. The second passage 512 is communicated to a connecting port 100*a* of the changeover valve 100 via a circular groove 515 and a connecting passage 515.

The changeover valve 100 is the same as the changeover valve in the above first embodiment. The oil is supplied to the second passage 512 while the solenoid 102 is not energized and the oil is supplied to the first passage 511 while the solenoid 102 is energized.

The inner rotor 520 is fixedly mounted on the projecting end of the cam shaft 510 via a spacer 590 by a bolt 591 so that the relative rotation between the inner rotor 520 and the cam shaft 510 is prevented. On the outer circumferential surface of the inner rotor 520, four axial grooves 521 in which the vanes 570 are mounted in the radial direction are formed thereon. Further, the inner rotor 520 is provided with a receiving hole 522 into which a head portion of a locking pin 590 is fitted by a predetermined amount when the relative phase between the inner rotor 520 and the outer rotor 530 is in a predetermined phase (the maximum retarded condition) shown in FIG. 16, a passage 523 which can communicate the receiving hole 522 and the first passage 511, passages 524 which communicate between first pressure chambers R1 (except for a first pressure chamber R1 located upper side in FIG. 16) divided by vanes 570 and the first passage 511 and passages 525 which communicate between second pressure chambers R2 divided by vanes 570 and the second passage 512. On the outer circumferential surface of the inner rotor 520, a groove 527 is formed thereon so as to extend in the circumferential direction. One end of the groove 527 communicates with the outer end of the passage 523 and the other end of that is communicated to the first pressure chamber R1 which is located upper side in FIG. 16. Further, an axial groove 528 is formed on the outer circumferential surface of the inner rotor 520 so as to extend from the opening end of the receiving hole 522 toward a rear plate 550. An axial groove 526 is formed on the outer circumferential surface of the inner rotor 520 so as to extend from the outer opening end of the passage 523 toward the rear plate 550. These axial grooves 528 and 526 are communicated with each other via a groove 532 which is formed on the rear side surface of the outer rotor 530 at the maximum retarded condition shown in FIG. 16. Therefore, the receiving hole 522 is communicated to the first passage 511 via the axial groove 528, the groove 532, the axial groove 526 and the passage 523 only when the relative phase between the inner rotor 520 and the outer rotor 530 is in the maximum retarded condition. Each vanes 570 is urged outwardly in the radial direction by a spring 571 which is disposed on the bottom portion of the groove 521. The diameter of the receiving hole 522 is slightly larger than that of the locking pin 580 (and the diameter of the retracting hole 534).

The outer rotor 530 is mounted on the outer circumference of the inner rotor 520 so as to be able to rotate a predetermined amount relative to the inner rotor 520. As shown in FIG. 15, a front plate 540 and the rear plate 550 are fluid-tightly connected on both sides of the outer rotor 530, and the front plate 540, the rear plate 550 and the outer rotor 530 are fastened by bolt 592. The timing sprocket 531 is formed on the outer circumference of the rear end of the outer rotor 530 in a body. Further, four projecting portions 533 which are projected inwardly are formed on the inner circumferential portion of the outer rotor 530. The inner circumferential surface of each projecting portions 533 is slidably mounted on the inner rotor 520. A retracting hole 534 in which the locking pin 580 and a spring 581 are disposed is formed in one of the projecting portion 533 and hollow portions 536, 537 are formed in this projecting portion 533.

The front plate 540 is a circular plate having a tubular portion 541 and communicating holes (not shown) which are corresponding to the hollow portions 536, 537 are formed therein. The front plate 540 is provided with a notch portion 546 with which one end of a torsion spring 560 is engaged. The rear plate 550 is a circular plate and is provided with communicating holes (not shown) which are corresponding to the hollow portions 536, 537.

Figure 16:
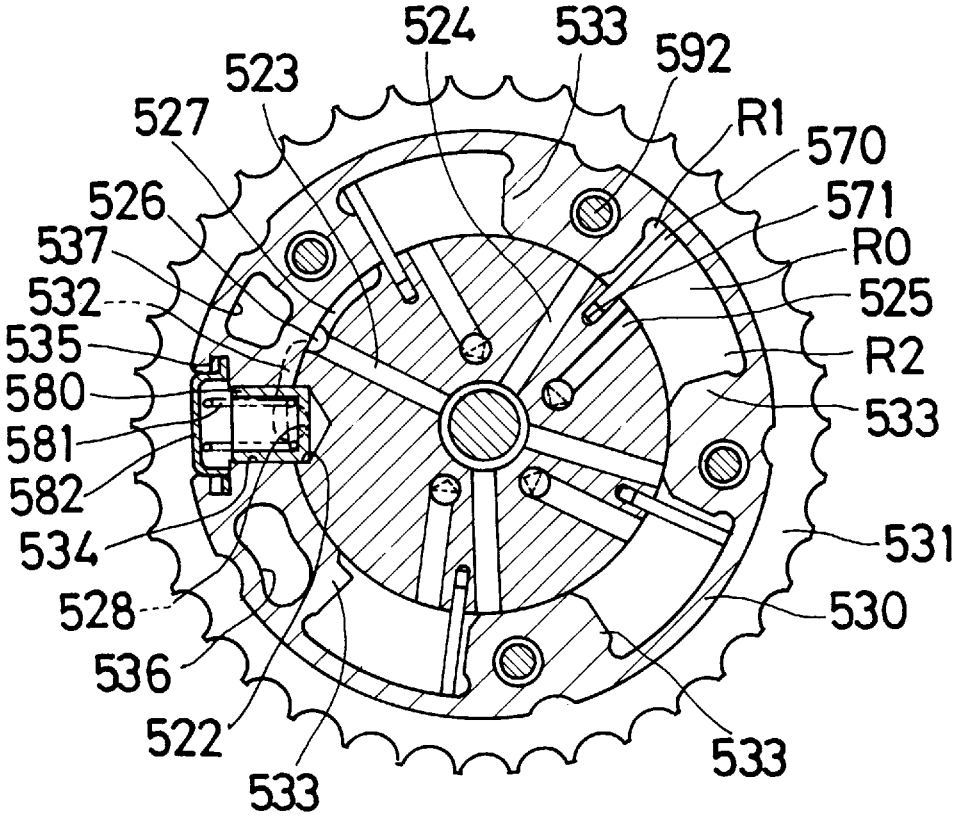
FIG. 16 shows a cross-sectional view taken on line D—D of FIG. 15.

The torsion spring 560 is engaged with the inner rotor 520 at its other end urges the inner rotor 520 relative to the outer rotor 530, the front plate 540 and the rear plate 550 clockwise in FIG. 16. The torsion spring 560 is provided considering the force which obstructs the rotation of the inner rotor 520 and the vanes 570 toward the advance side. The torsion spring 560 urges the inner rotor 520 relative to the outer rotor 530, the front plate 540 and the rear plate 550 toward the advance side and thereby the response of the rotation of the inner rotor 520 toward the advance side is improved.

Each vanes 570 is disposed in each pressure chambers R0 formed between the adjacent projecting portions 533 and divides the pressure chamber R0 into the first pressure chamber R1 and the second pressure chamber R2.

The locking pin 580 is fitted in the retracting hole 534 so as to be able to move in the radial direction of the outer rotor 530 and is urged toward the inner rotor 520 by the spring 581 which is disposed between the locking pin 580 and a retainer 582. In this embodiment, a groove 535 which penetrates the retracting hole 534 at the outer end of the retracting hole 534 and whose one end is opened into the front side surface of the outer rotor 530 is formed on the outer rotor 530. The plate-shaped retainer 582 is fitted into the groove 535 from the front side surface side of the outer rotor 530 and the one end of the spring 581 is engaged with the retainer 582.

In this third embodiment, while the engine is at rest, the oil pump P also remains non-operational and the changeover valve 100 is in the condition shown in FIG. 15. Therefore, each member is in the condition shown in FIG. 15 and FIG. 16 (the relative phase between the inner rotor 520 and the outer rotor 530 is locked by the locking pin 580 at the maximum retarded condition under which the volume of the each of the second pressure chambers R2 becomes a maximum value) and the oil under pressure is not supplied to the first and second passages 511, 512. Thereby, when the engine is started, non-necessary relative rotation between the rotation shaft comprising of the cam shaft 510, the inner rotor 520, the vanes 570 and so on and the rotation transmitting member comprising of the outer rotor 530, the timing sprocket 531, the front plate 540, the rear plate 550 and so on due to the large rotational variation is regulated and the drawback due to the unnecessary relative rotation between the rotation shaft and the rotation transmitting member (for example, collision noise by the vanes 570) is avoided.

Further, at the starting of the engine, the changeover valve 100 is changed over, and the oil is supplied from the oil pump P to the passage 516 via the changeover valve 100 for at least a predetermined time. Thereby, the oil is supplied to the first pressure chambers R1 via the first passage 511, the passages 524, the passage 523 and the groove 527 and is supplied to the receiving hole 522 via the first passage 511, the passage 523, the axial groove 526, the groove 532 and the axial groove 528. Thereby, when the locking pin 580 is moved against the spring 581 and a predetermined time (a time required for supplying a predetermined amount of oil to the receiving hole 522) elapses since the engine is started, the head portion of the locking pin 580 moves from the receiving hole 522 into the retracting hole 534 as shown in FIG. 17 and the locking condition by the locking pin 580 is released.

Figure 17:
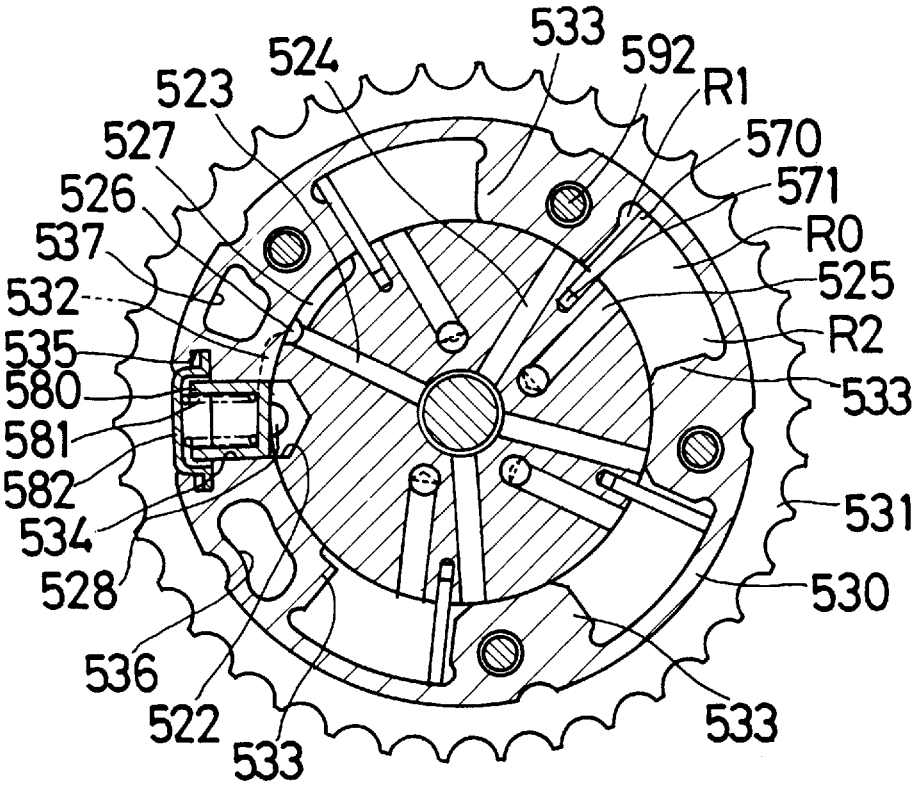
FIG. 17 shows a cross-sectional view of the third embodiment of a valve timing control device in which the locking pin is moved out of the receiving hole.

Accordingly, when the predetermined time elapses since the engine is started, as shown in FIG. 17, the rotation shaft comprising of the cam shaft 510, the inner rotor 520, the vanes 570 and so on can be rotated relative to the rotation transmitting member that comprises the outer rotor 530, the timing sprocket 531, the front plate 540, the rear plate 550 and so on. When the oil is discharged from the second pressure chambers R2 and the oil is supplied to the first pressure chambers R1 by the changing operation of the changeover valve 100 in response to the running condition of the engine, the rotation shaft ran be rotated relative to the rotation transmitting member from the condition shown in FIG. 17 to the maximum advanced condition in which the volume of the second pressure chambers R2 become minimum value via the condition shown in FIG. 18. Further, when the oil is discharged from the first pressure chambers R1 and the oil is supplied to the second pressure chambers R2 by the changing operation of the changeover valve 100, the rotation shaft can be rotated relative to the rotation transmitting member from the maximum advanced condition to the condition shown in FIG. 17 via the condition shown in FIG. 18. Thereby, the opening and closing timing of the valves (not shown) driven by the cam shaft 510 in adjusted and the angular phase difference between the crank shaft 12 and the cam shaft 510 is adjusted. It is therefore able to maintain the neutral condition, for example, the condition shown in FIG. 18, by maintaining the oil pressure of the first and second pressure chambers R1 and R2.

Figure 18:
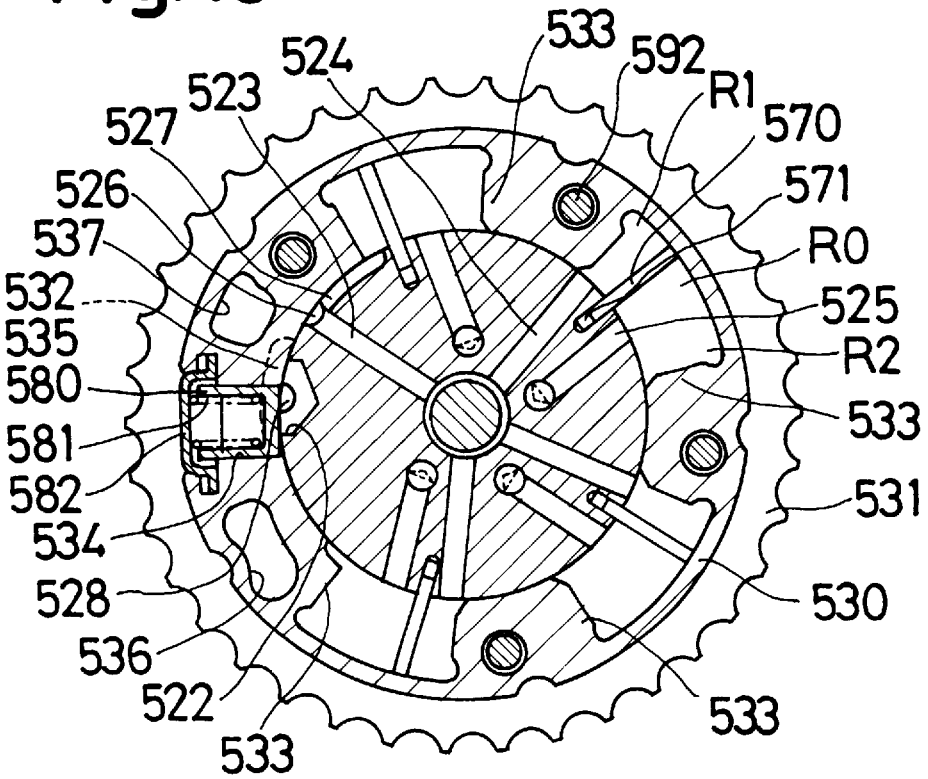
FIG. 18 shows a cross-sectional view of the third embodiment of a valve timing control device in which the rotation shaft is rotated toward advance side relative to the rotation transmitting member.

In the above second embodiment, when the receiving hole 522 is not in alignment with the retracting hole 534, as shown in FIG. 18, the fluid communication between the axial groove 526 and the groove 532 is interrupted and the receiving hole 52 is sealed or closed. In this condition, since the oil is not communicated to the receiving hole 522, the supplying and discharging of oil to and from the first and second pressure chamber R1 and R2 are controlled. Further, even if the oil pressure in the passage 523 and the axial groove 526 changes, the pressure change does not transmit to the receiving hole 522. Therefore, it is able to prevent the locking pin 580 from vibrating in the retracting hole 534 and it is possible to reduce the acoustic noise generated by the vibration of the locking pin 580.

In this third embodiment, the receiving hole 522 is in alignment with the retracting hole 534 at the maximum retarded condition. However, it is able to be in alignment the receiving hole 522 with the retracting hole 534 at the maximum advanced condition. In this case, the third passage for communicating to the receiving hole 522 is communicated to the passages 525 when the receiving hole 522 is in alignment with the retracting hole 534 and the fluid communication between the third passage and the passages 525 is interrupted when the receiving hole 522 is not in alignment with the retracting hole 534 (when the inner rotor 520 is rotated relative to the outer rotor 530 with a predetermined angle). In this case, the third passage is constituted by axial grooves and by grooves as in the above third embodiment. Further, it is able to apply the oil pressure for lubricating the journal portions of the cam shaft 510 to the back surface of the vanes 570. In this case, it is possible to not use the vane springs 571.

In the above first, second and third embodiments, the vanes are connected to the inner rotor, and the locking pin and the spring are disposed in the outer rotor. However, the vanes may be connected to the outer rotor and the locking pin and the spring may be disposed in the inner rotor. Further, in the above embodiments, the valve timing control device is used with the cam shaft for opening and closing the intake valves. However, it is possible to use the cam shaft for opening and closing the exhaust valves.

The principles, preferred embodiments and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve timing control device comprising:

a rotation shaft for opening and closing a valve;

a rotation transmitting member rotatably mounted on the rotation shaft;

a vane connected to one of the rotation shaft and the rotation transmitting member;

a chamber defined between the rotation shaft and the rotation transmitting member and divided into a first pressure chamber and a second pressure chamber by the vane being extended into the chamber;

a first fluid passage in fluid communication with the first pressure chamber for supplying and discharging the fluid therein and therefrom, respectively;

a second fluid passage in fluid communication with the second pressure chamber for supplying and discharging the fluid therein and therefrom;

a retracting hole formed on one of the rotation shaft and the rotation transmitting member;

a locking pin slidably fitted in the retracting hole and urged toward the other of the rotation shaft and the rotation transmitting member;

a receiving hole formed on the other of the rotation shaft and the rotation transmitting member and in which a part of the locking pin is fitted when the relative phase between the rotation shaft and the rotation transmitting member is in a predetermined phase; and a third fluid passage in fluid communication with the receiving hole only when the relative phase between the rotation shaft and the rotation transmitting member is in the predetermined phase.

2. A valve timing control device recited in claim 1, wherein the third fluid passage includes a first part which is formed on one of the rotation shaft and the rotation transmitting member and a second part formed on the other of the rotation shaft and the rotation transmitting member.

3. A valve timing control device recited in claim 1, wherein the third fluid passage is formed on the sliding surface between the rotation shaft and the rotation transmitting member.

4. A valve timing control device recited in claim 3, wherein the third fluid passage is constituted by the second pressure chamber and a restricted passage formed on the sliding surface between the rotation shaft and the rotation transmitting member.

5. A valve timing control device recited in claim 2, wherein the third fluid passage is formed to communicate with one of the first fluid passage and the second fluid passage.

6. A valve timing control device recited in claim 1, further comprises a fourth fluid passage in fluid communication with the retracting hole only when the relative phase between the rotation shaft and the rotation transmitting member is in the predetermined phase.

* * * * *

UNITED STATES PATENT AND TRADEMARK OFFICE

CERTIFICATE OF CORRECTION

PATENT NO. : 5,836,277
DATED : November 17, 1998
INVENTOR(S) : Kira *et al.*

It is certified that error appears in the above-identified patent and that said Letters Patent is hereby corrected as shown below:

On the title page,

Item [30], line 2, delete "8-344122" and insert in place thereof --8-343122--.

Signed and Sealed this

Twenty-fifth Day of May, 1999

*Attest:*

Q. TODD DICKINSON

*Attesting Officer*

*Acting Commissioner of Patents and Trademarks*